US006355891B1

(12) United States Patent
Ikunami

(10) Patent No.: US 6,355,891 B1
(45) Date of Patent: Mar. 12, 2002

(54) OPERATING APPARATUS

(75) Inventor: Takahiro Ikunami, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/582,031

(22) PCT Filed: Oct. 30, 1998

(86) PCT No.: PCT/JP98/04945

§ 371 Date: Jun. 21, 2000

§ 102(e) Date: Jun. 21, 2000

(87) PCT Pub. No.: WO00/26931

PCT Pub. Date: May 11, 2000

(51) Int. Cl.[7] ..... H01H 23/00

(52) U.S. Cl. ..... 200/315; 200/553; 200/557; 200/339

(58) Field of Search ..... 200/329–339, 200/553–563, 7 R, 5 A

(56) References Cited

U.S. PATENT DOCUMENTS 4,401,864 A * 8/1983 Ichikawa ..... 200/17 R
4,520,240 A * 5/1985 Swindler ..... 200/339 X
5,087,798 A * 2/1992 Rohde et al. ..... 200/339 X
5,514,843 A * 5/1996 Wilfong et al. ..... 200/339 X
5,584,380 A * 12/1996 Naitou ..... 200/339 X

FOREIGN PATENT DOCUMENTS

| | | |
|---|---|---|
| JP | 718332 | 3/1995 |
| JP | A7326260 | 12/1995 |
| JP | A8138497 | 5/1996 |
| JP | A7211195 | 8/1996 |
| JP | A8222084 | 8/1996 |
| JP | A8264073 | 10/1996 |
| JP | A9115391 | 5/1997 |
| JP | A9223437 | 8/1997 |

* cited by examiner

*Primary Examiner*—J. R. Scott

(57) ABSTRACT

An operation device is provided with an outer support section 1*c* which projects towards an outer face of a button 1, an inner support section 1*e* which projects towards an inner face of said button 1, a maintaining section 5*b* which is provided on a decorative front panel 5 and which maintains said outer support section in free rotation, a maintaining section 3*a* which is provided on a button depression member 3 and which maintains said inner support section 1*e* in free rotation and a flange 1*b* which is provided continuously on the outer edge of the aperture of the button 1. Thus it is possible to provide a smaller device than the conventional example while maintaining the rigidity of the outer support section 1*c*. A smaller button 1 and smooth see-saw operation can be realized as well as reductions in escaped light.

6 Claims, 14 Drawing Sheets

11-11

13-13

19-19

28-28

OPERATING APPARATUS

This application is the national phase under 35 U.S.C. §371 of PCT International Application No. PCT/JP98/04945 which has an International filing date of Oct. 30, 1998, which designated the United States of America.

FIELD OF THE INVENTION

The present invention is related to an operation device which is used in an car audio system and which performs the switching of input operations by the so-called see-saw method.

PRIOR ART

An operation device which performs various kinds of switching operations is provided, for example, in a control panel of a car audio system. This type of device is provided with a depressable button (hereafter simply called "button") for performing the switching of input operations by the so-called see-saw method between two functions such as fast-forwarding or reversing a cassette tape. Furthermore the button of the operation device is formed so as to be illuminated from the rear so that the button is visible in darkness.

A conventional device will be explained below with reference to the accompanying figures. FIG. 22 is a schematic perspective view of a conventional operation device. FIG. 23 is a plan view of a button. FIG. 24 is a lateral view of button. FIG. 25 rear view of a button. FIG. 26 is a lateral view of a button. FIG. 27 is a cross sectional view along the line 27—27 of FIG. 23. FIG. 28 is a cross sectional view along the line 28—28 of FIG. 22. FIG. 29 is a cross sectional view along the line 29—29 of FIG. 22. FIG. 30 is a cross section view of the operation of a button.

In the figures, reference numeral 31 is a button which operates a switching input operation by a see-saw operation and is formed in a box shape with an aperture 31*a*. The button 31 is formed by a transparent resin. 31*b* is a flange which is formed on the outer edge of the aperture 31*a*. 31*c* is a cylindrical spindle which acts as a point of support for the see-saw operations. The spindle 31*c* projects so as to co-planar with the surface of the flange 31*b* from both sides of the button 31 and is maintained in free rotation by the maintaining sections 33*a*, 35*b* to be discussed below. 31*d* is a notch which is provided in the flange in proximity to the spindle 31*c*. 32 is a printed wiring board, 33 is a button depression section, 33*a* is a maintaining section which is provided at a position which corresponds to the notch 31*d* of the button depression member 33 and which supports the spindle from below. 34 is a cushion member which returns the button 31 to a pre-operational position after operation. 35 is a decorative panel, 35*a* is a button through hole which allows the passage of the button 31, 35*b* is a maintaining section which together with the maintaining section 33*a* supports the spindle 31*c* in free rotation. 36 is a switching element which is depressed by see-saw operations of the button 31. 37 is a lamp which illuminates the button 31 from the rear.

The operation of the invention will be explained below.

As shown in FIG. 30, when a button 31 is depressed in the direction of the arrow in the figure, the button 31 inclines by rotating about the spindle 31*c*. In doing so, the flange 31*b* pushes the cushion member 34 which undergoes elastic deformation. On the other hand, when pressure is applied to the switch element, a defined input operation is performed. When pressure is no longer applied to the button 31, the button is pushed back due to the rebounding force of the cushion member 34 and returns to a pre-operational position.

The button 31 is illuminated by a lamp 37 during operations in darkness and so its visibility is ensured.

Another conventional example will be discussed below.

FIG. 31 is a component figure of another conventional device. FIG. 32 is a plan figure of a button. FIG. 33 is a lateral figure of a button. FIG. 34 is a rear figure of a button. FIG. 35 is a lateral figure of a button. FIG. 36 is a cross sectional view along the line 36—36 of FIG. 32. FIG. 37 is a cross sectional view along the line 37—37 of FIG. 31. FIG. 38 is a cross sectional view along the line 38—38 of FIG. 31. In the explanation below, those components which have already been explained are referred to by the same reference numerals and their explanation will be omitted.

In the figures, reference numeral 41 refers to a button which performs switching input operations by a see-saw operation and is formed in a box shape which has an aperture 41*a*. The button 41 is formed from a transparent resin. 41*b* is a flange which is continuously formed along the outer edge of the aperture 41*a*. 41*c* is a cylindrical spindle which is the point of support for see-saw operations. The spindle 41*c* projects so as to be co-planar with the surface of the flange 41*b* from both sides of the button 41 and is maintained in free rotation by the maintaining sections 33*a*, 35*b*.

The operation is the same as the first conventional example which has been explained above and so will not be repeated.

Since the conventional operation device is constructed in such a way, in order to maintain the operation space of the maintaining section 35*b* when the button 31 is operated, a notch 31*d* must be provided on the flange 31*b*. Thus the problem arises of light from the lamp 37 escaping from the notch 31*d*.

Furthermore in order to perform smooth see-saw operations, it is advantageous that the spindle 31*c* is formed with a small diameter, and the frictional resistance of the maintaining sections 33*a*, 35*b* is reduced. However in consideration of the rigidity of the spindle 31*c*, the effective minimum diameter is limited which thus increases the problem of reducing frictional resistance.

Furthermore returning the button 31 after the switching operation to an initial position requires a separate operation of the cushion member 34. Thus this entails problems of an increased number of components and assembly operations as well as increases in costs.

Since the conventional device is constructed as above, although it is possible to prevent light of the lamp 37 from escaping by a flange 41*b* formed on the entire circumference of the button 41, the problems have arisen that the spindle 41*c* of the button 41*b* projects more than the flange 41*b* and that the outer diameter of the button 41 is increased. Tokkai-Hei-9-223437 discloses a conventional device with the object of preventing light escaping without inhibiting the miniaturization of the device.

The present invention is proposed to solve the above problems and has the object of providing an operation device which can reduce escaping light when a button is illuminated, which allows the miniaturization of the device. The present invention also allows the smooth performance of the see-saw operation of the button.

The present invention allows a button to return to a pre-operational position after a switching input operation without the use of a separate cushion member which allows a reduction in costs.

DISCLOSURE OF THE INVENTION

The present invention comprises an outer support section which projects towards an outer face of said button, an inner support section which projects towards an inner face of said button, a maintaining section for said outer support section which is provided on a front wall face and which maintains said outer support section in free rotation, and a maintaining section for said inner support section which is provided on a button depression member and which maintains said inner support section in free rotation.

In this way, rigidity may be maintained and a smaller outer support section than the conventional device may be formed. Thus it is possible to miniaturize the device and smoothly perform see-saw operations.

The present invention employs a cushion member which is provided on the button depression member as a button return member.

In this way, it is possible to return the button to a pre-operational position with a simple structure.

The present invention uses an elastic piece which is integrated with the maintaining section of the button depression member as a button return member.

In this way, it is possible to reduce the number of separate components such as the cushion member, to simplify assembly procedures and to reduce costs.

The present invention provides an illumination element which illuminates the button of an operation device, which is provided with a cushion member, from the rear. The illumination element is provided on a mounting board. A flange is provided which is continuous with the outer edge of the aperture of the button.

In this way, it is possible to reduce escaping light.

PREFERRED EMBODIMENTS OF THE INVENTION

The preferred embodiments of the invention are explained in further detail below with reference to the accompanying figures.

Embodiment 1

Figure 1:
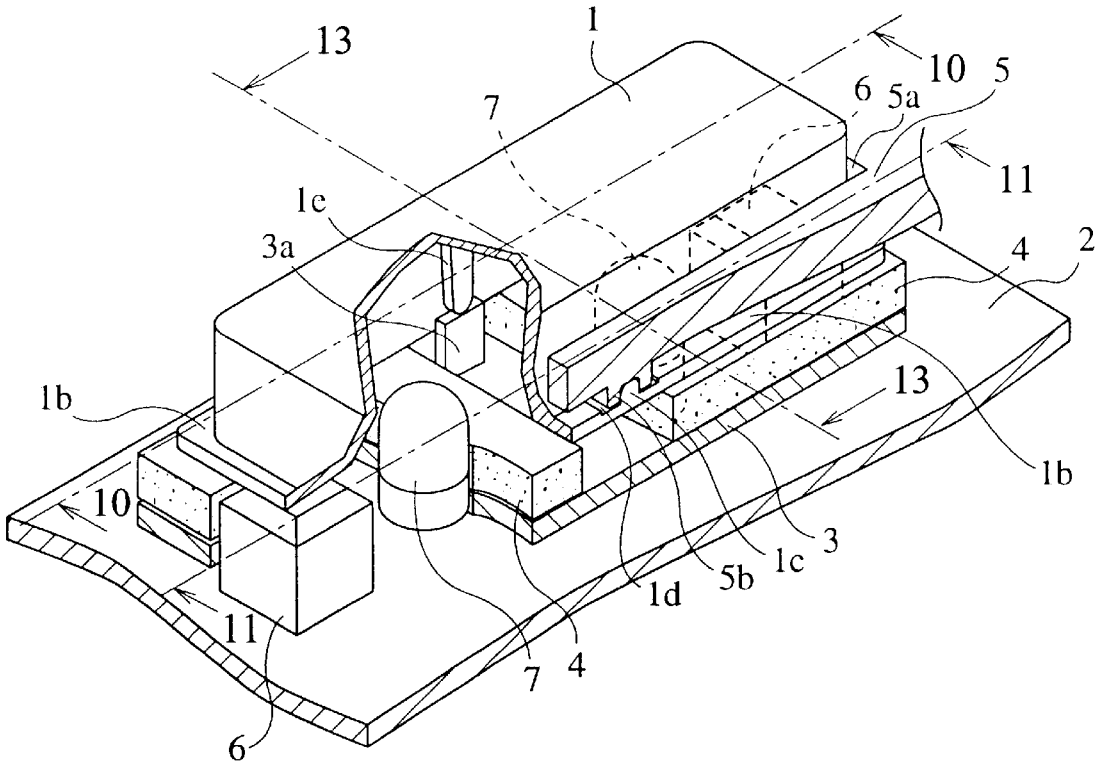
FIG. 1 is a component perspective figure of a first embodiment of the present invention.
Figure 2:
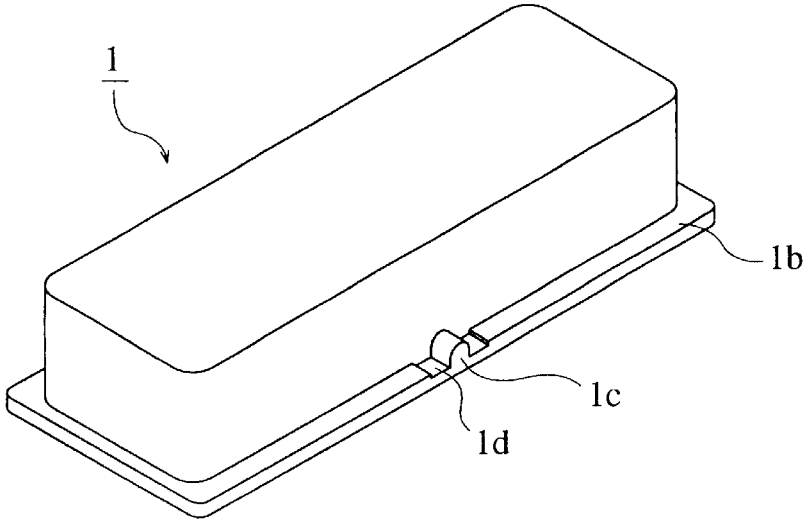
FIG. 2 is a front perspective figure of a button.
Figure 3:
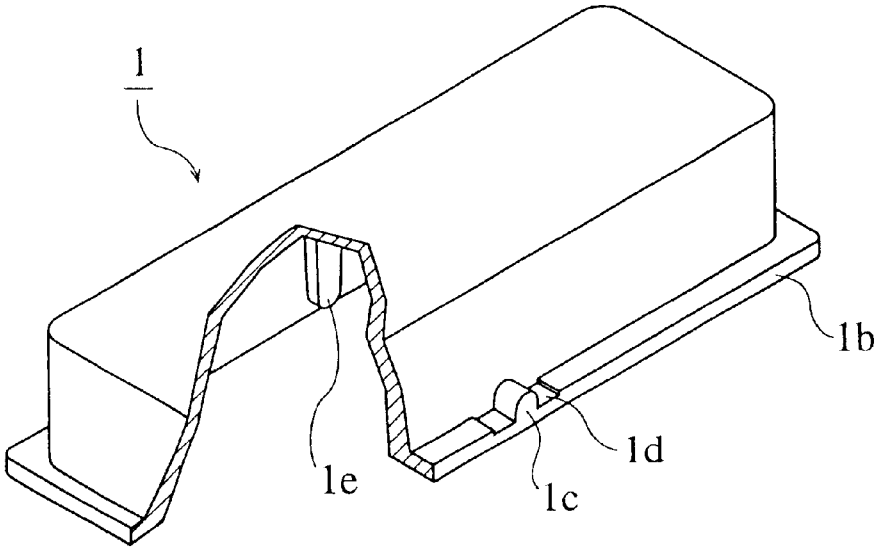
FIG. 3 is a front perspective figure of a button shown in partial cross section.
Figure 4:
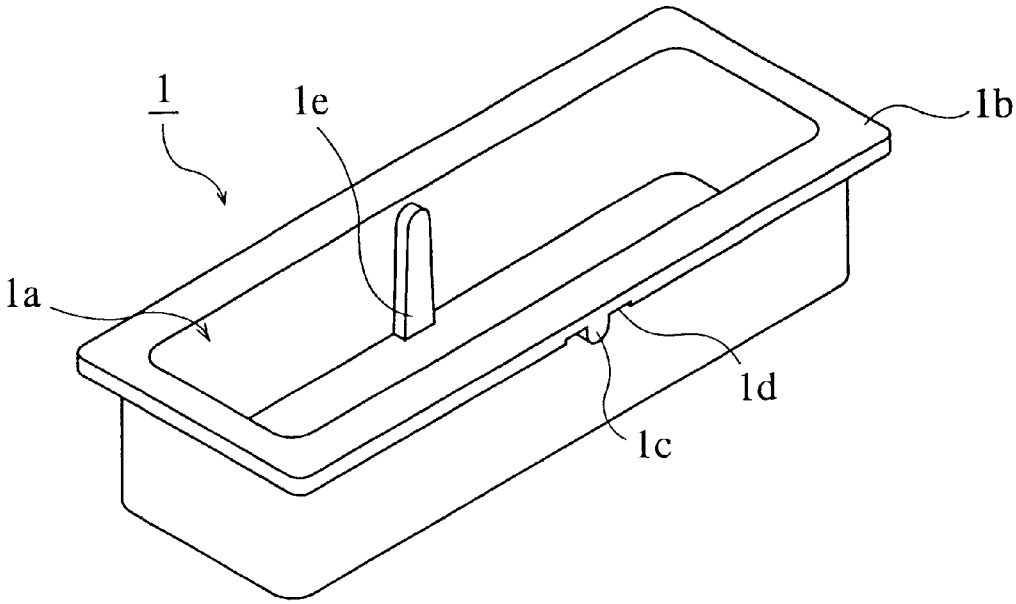
FIG. 4 is a rear perspective figure of a button.
Figure 5:
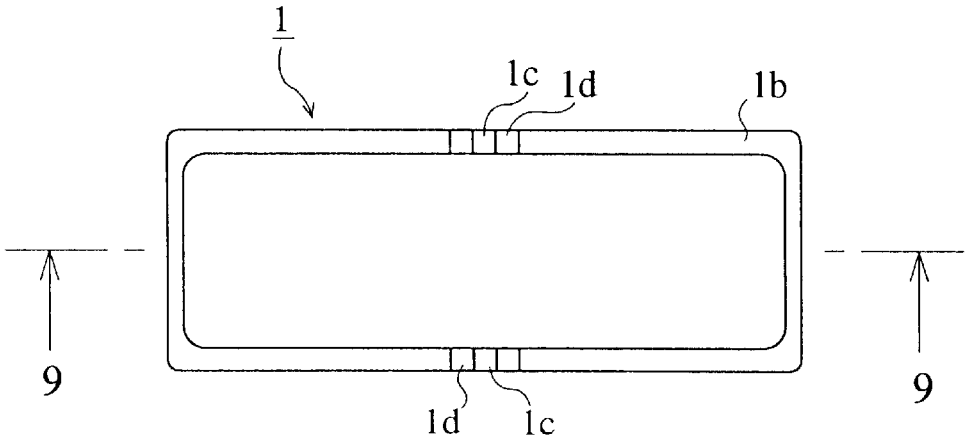
FIG. 5 is a plan view of a button.
Figure 6:
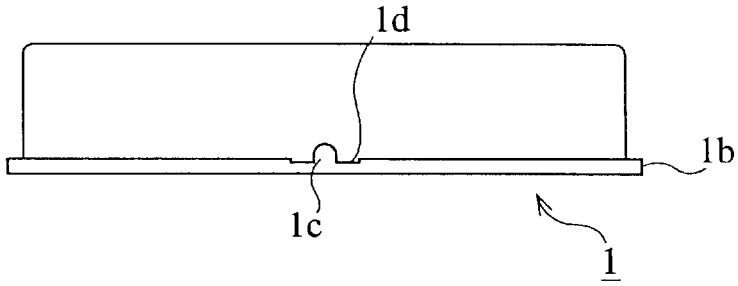
FIG. 6 is a lateral view of a button.
Figure 7:
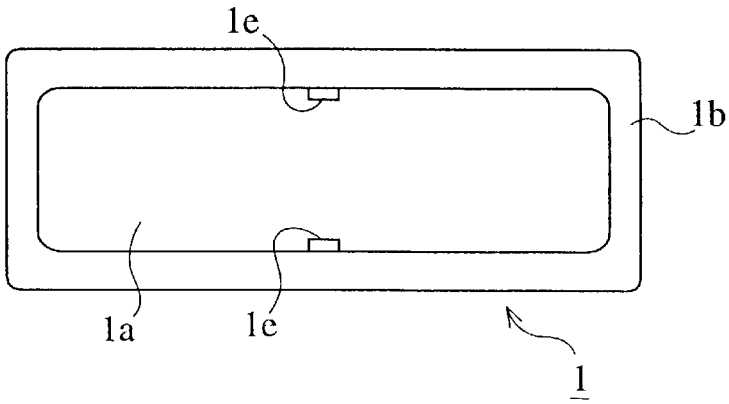
FIG. 7 is a rear view of a button.
Figure 8:
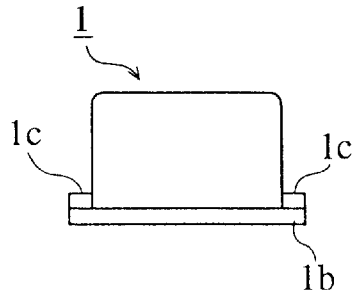
FIG. 8 is a lateral view of a button.
Figure 9:
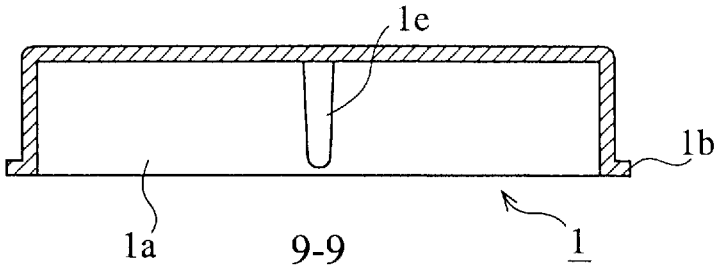
FIG. 9 is a cross sectional view along the line 9—9 of FIG. 5.
Figure 10:
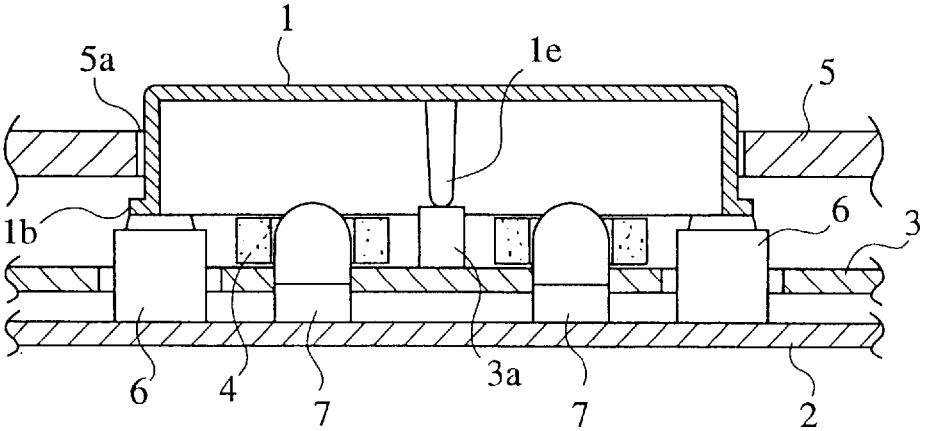
FIG. 10 is a cross sectional view along the line 10—10 of FIG. 1.
Figure 11:
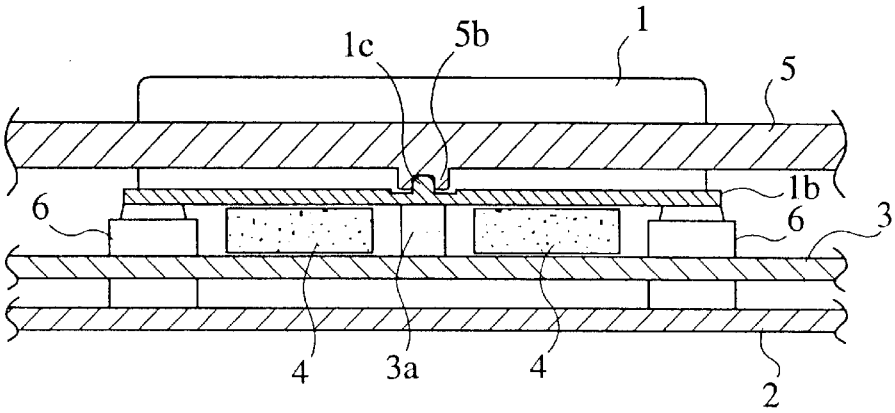
FIG. 11 is a cross sectional view along the line 11—11 of FIG. 1.
Figure 12:
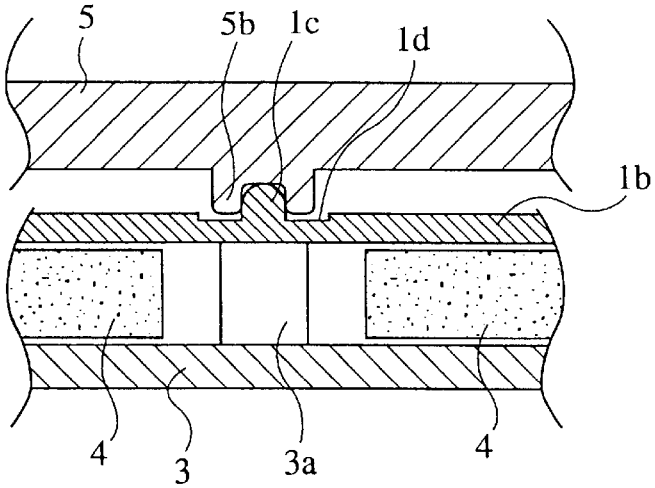
FIG. 12 is an enlarged view of the proximity of the outer support section of the button in FIG. 11.
Figure 13:
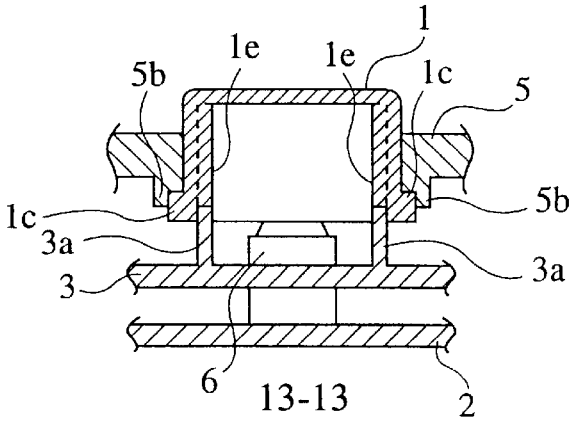
FIG. 13 is a cross sectional view along the line 13—13 of FIG. 1.
Figure 14:
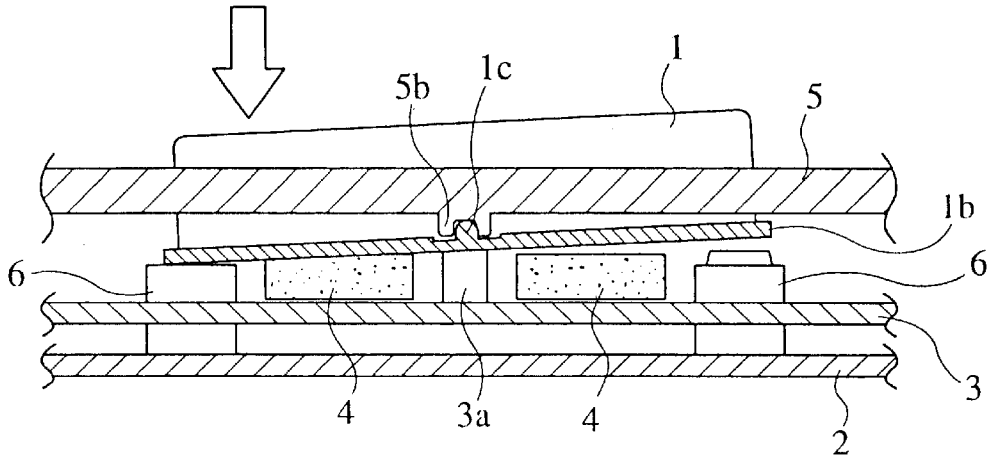
FIG. 14 is a cross sectional view showing the operational state of a button.

FIG. 1 is a schematic perspective figure of a first embodiment of the present invention. FIG. 2 is a front perspective figure of a button. FIG. 3 is a front perspective figure of a button shown in partial cross section. FIG. 4 is a rear perspective figure of a button. FIG. 5 is a plan view of a button. FIG. 6 is a lateral view of a button. FIG. 7 is a rear view of a button. FIG. 8 is a lateral view of a button. FIG. 9 is a cross sectional view along the line 9—9 of FIG. 5. FIG. 10 is a cross sectional view along the line 10—10 of FIG. 1. FIG. 11 is a cross sectional view along the line 11—11 of FIG. 1. FIG. 12 is an enlarged view of the proximity of the outer support section of the button in FIG. 11. FIG. 13 is a cross sectional view along the line 13—13 of FIG. 1. FIG. 14 is a cross sectional view showing the operational state of a button.

In the figures, reference numeral 1 refers to a a button which performs switching input operations by a see-saw operation and is formed in a box shape with an aperture 1*a*. 1*b* is a flange which is formed continuously on the outer periphery of the aperture 1*a*. 1*c* is an outer support section which acts as a support point for see-saw operations and which projects outwardly from the center of the outer wall of the button 1 so that it is coplanar with the flange 1*b*. The outer support section is maintained in free rotation by the maintaining section 5*b* which is explained below. The upper end face of the outer support section 1*c* is formed in a semi-circle so as to reduce the frictional resistance with the maintaining section 5*b* to be discussed below and its base is integrated continuously with the flange 1*b*. The outer support section 1*c* maintains a sufficient rigidity by being continuously integrated with the flange 1*b* and the outer wall face of the button 1 and the outer diameter of the above semi-circle shape is formed so as to be smaller than the conventional example.

1*d* is an indentation which is formed as an operational space for the maintaining section 5*b* to be explained below. 1*e* is an inner support section which acts as a point of support for see-saw operations. The inner support section 1*e* projects inwardly from the central inner wall face of the button 1 and is mounted on the maintaining section 3*a*. The lower section of the inner support section 1*e* is formed in a semi-circular shape. The center of that semi-circle and the center of the semi-circle of the outer support section 1*c* are mounted on the same line so as to become the rotational center of the button 1. This type of button 1 is integrated with a resin that has a light dispersing characteristic (such as PC resin or ABS resin) so as to have a fixed transparency.

2 is a printed wiring board (mounting base), 3 is a button depression member which is mounted on the printed wiring board 2 and on which is arranged a maintaining section 3*a* (maintaining section for inner support section) which maintains the abutment with the inner support section 1*e* from below. In other words, the maintaining section 3*a* differs from the conventional maintaining section 33*a* in that it is arranged at the position at which the button 1 is enveloped. The button depression member 3 can be formed from the same material as the button 1. 4 is a cushion member (button return member) which is mounted on the lower section of the button 1 for returning the button 1 to a pre-operational position after the application of pressure to the button 1. For example, it may be formed by sponge rubber, urethane foam, or the like.

5 is a decorative panel (front plate), 5*a* is a button through-hole which allows the passage of the button 1, 5*b* is a maintaining section (maintaining section for outer support section) which projects downwardly from the rear face of the decorative panel 5 in order to support the outer support section 1*c* in free rotation. 6 is a switch element which is arranged on the printed wiring board and which is pressured when the see-saw operation of the button 1 is performed. 7 is a lamp (illumination element) which is arranged on the printed wiring board and which illuminates the button 1 from the rear and which may for example be formed by using LED or the like.

Although the operation device above was described as using one button for the sake of simplicity, it is possible to use a plurality of buttons as required when the operation device is applied to the operational panel of a car audio.

The operation of the invention will be explained below.

As shown in FIG. 14, when a button 1 is pressured from the direction of the arrow in the figure, the button 1 slopes about the rotational center of the outer support section 1*c*. In this way, while the flange 1*b* pressures the cushion member 4 which undergoes elastic deformation, the other switching element 6 is pressured and so a defined input operation is performed. When the pressure on the button 1 is released, the button is returned by the elastic force of the cushion member 4 and returns to a pre-operational position.

Since the outer diameter of the upper end face of the outer support section 1*c* is formed so as to be smaller than the conventional example, it is possible to reduce the frictional resistance between the outer support section 1*c* and the maintaining section 5*b* during the see-saw operation of the button 1 and thus to perform pressuring operations more smoothly than the conventional example.

During operation in darkness, the visibility of the button 1 is maintained by the lamp 7. At such times, since a flange 1*b* is continuously formed on outer edge of the aperture 1*a*, the amount of light of the lamp 7 which escapes from the button through hole 5*a* is reduced.

As shown above, according to embodiment 1, since a button 1 is maintained by an outer support section 1*c* and a maintaining section 5*b*, and an inner support section 1*e* and a maintaining section 3*a*, it is possible to form a device which has a smaller degree of projection of the outer support section 1*c* and a smaller outer diameter of the upper wall face than the conventional example. It is also possible to continuously form a flange 1*b* on the outer edge of the aperture 1*a*. Thus a small sized button 1 may be formed which can smoothly perform see-saw operations together with a reduction in the amount of light which escapes when the lamp is illuminated.

Embodiment 1 above was explained with a lamp 7 provided on a printed wiring board 2 and a flange 1*b* provided on a button 1. However the invention is not limited in this respect and when the device is not operated in darkness, such components need not be provided.

Embodiment 2

Figure 15:
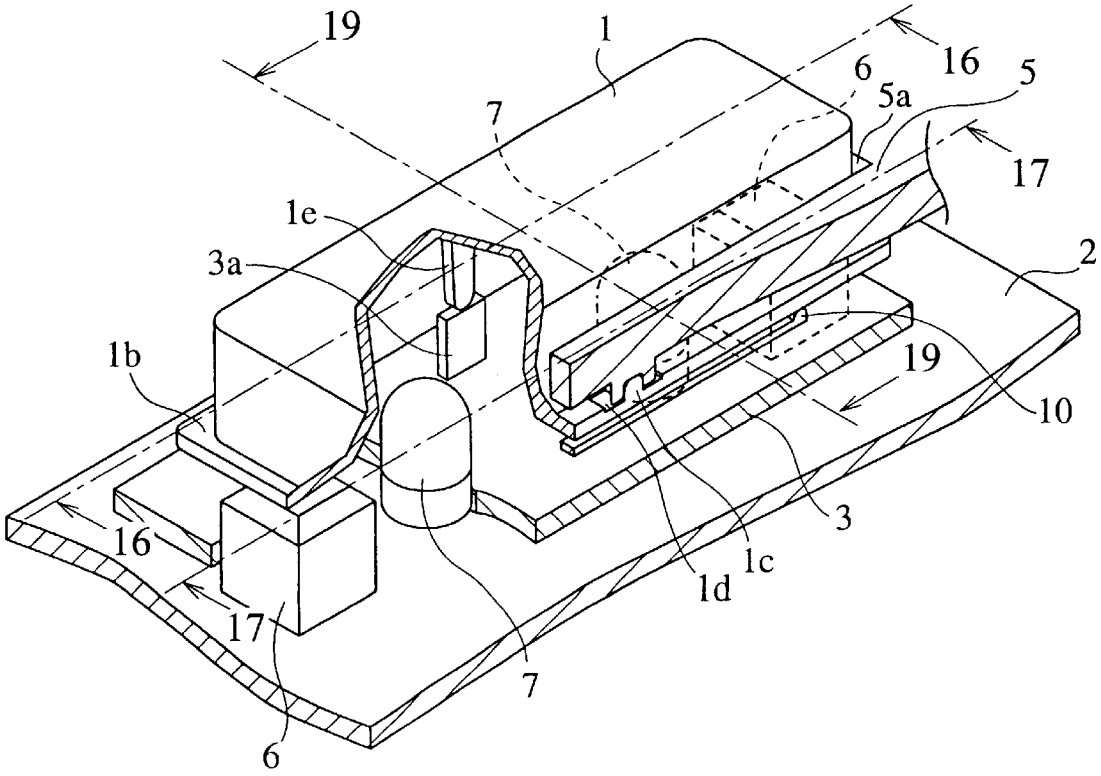
FIG. 15 is a schematic perspective figure of a second embodiment of the present invention.
Figure 16:
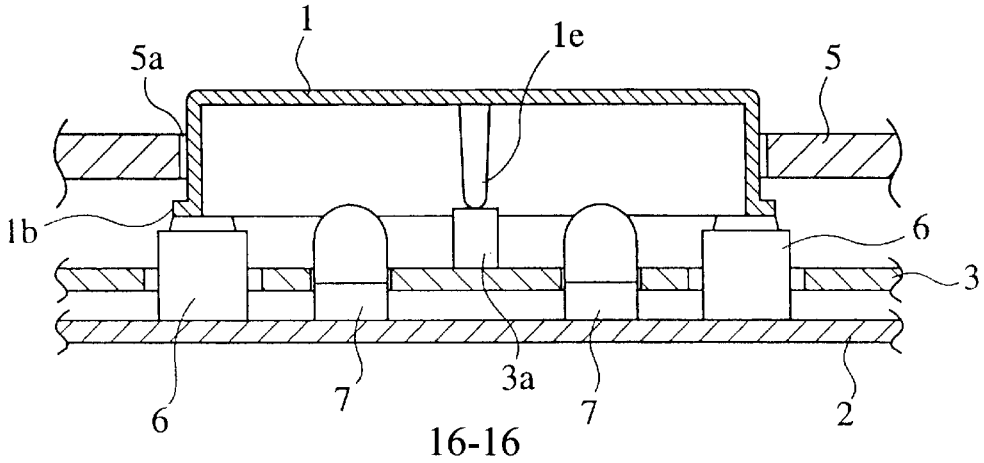
FIG. 16 is a cross sectional view along the line 16—16 of FIG. 15.
Figure 17:
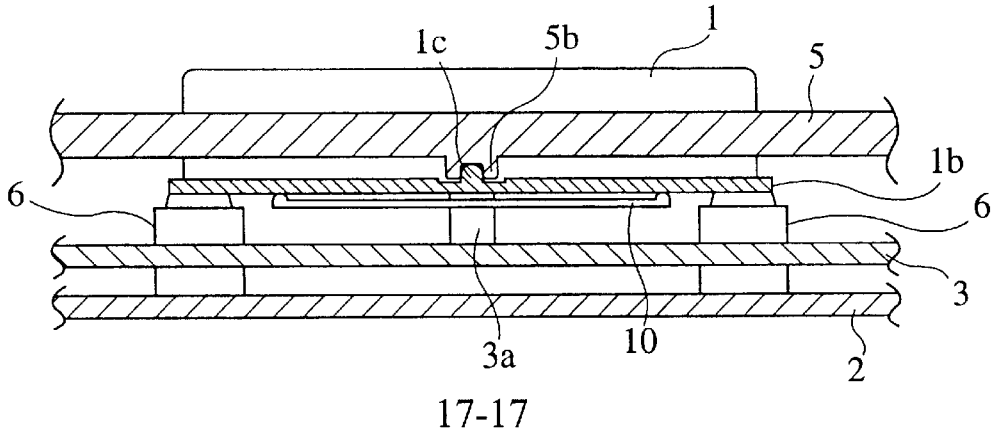
FIG. 17 is a cross sectional view along the line 17—17 of FIG. 15.
Figure 18:
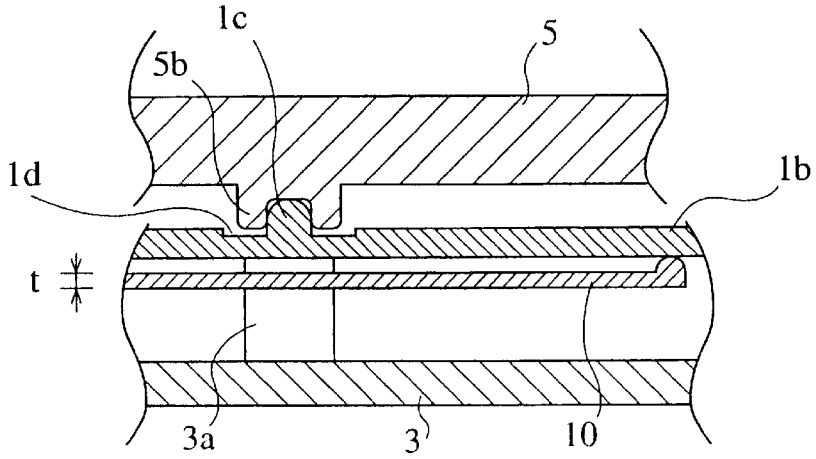
FIG. 18 is an enlarged view of the proximity of the outer support section of the button in FIG. 17.
Figure 19:
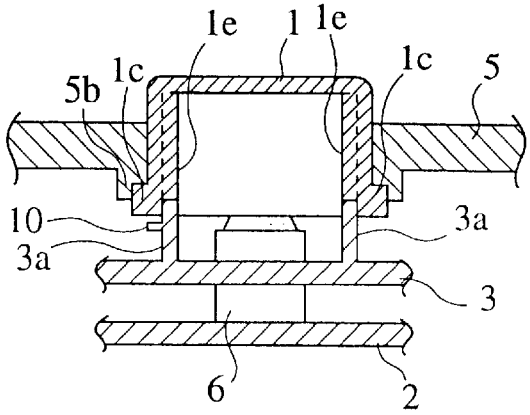
FIG. 19 is a cross sectional view along the line 19—19 of FIG. 15.
Figure 20:
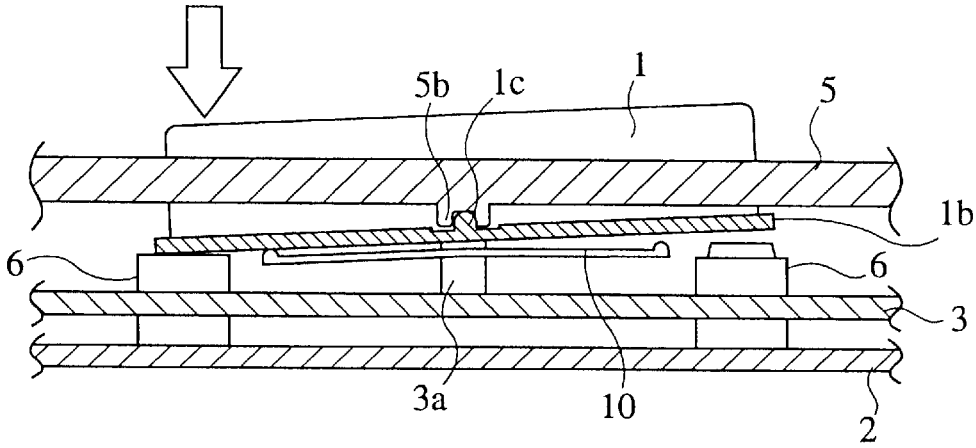
FIG. 20 is a cross sectional view showing the operational state of a button.

FIG. 15 is a schematic perspective figure of a second embodiment of the present invention. FIG. 16 is a cross sectional view along the line 16—16 of FIG. 15. FIG. 17 is a cross sectional view along the line 17—17 of FIG. 15. FIG. 18 is an enlarged view of the proximity of the outer support point of the button in FIG. 17. FIG. 19 is a cross sectional view along the line 18—18 of FIG. 15. FIG. 20 is a cross sectional view showing the operational state of a button.

In the figures, 10 is an elastic piece (button return member) which is integrated with one of the maintaining sections 3*a* of the button depression member 3 so as to abut with the lower face of the flange section 1*b*. The elastic piece returns to a pre-operational position after pressure is applied to the button 1. In other words, it may be used instead of the cushion member 4 above. The letter t represents the thickness of the elastic piece 10.

The operation of the invention will be explained below.

As shown in FIG. 20, when the button 1 is depressed in the direction of the arrow in the figure, the button 1 slopes about the rotational center of the outer support section 1*c*. In this way, while the flange 1*b* pressures one end of the elastic piece 10 which undergoes elastic deformation, the other switch element is pressured and a fixed input operation is completed. When the pressure is released from the button 1, the button returns to a pre-operational position due to the elastic force of the elastic piece 10. Other operations are the same as those of the first embodiment and will not be explained again.

As shown above according to embodiment 2 of the present invention, apart from obtaining the same effect as the first embodiment, it is possible to reduce the number of separate components such as the cushion member 4, to simplify assembly procedures and reduce costs by the integrated formation of an elastic piece 10 on the button depression member 3.

Embodiment 2 was explained on the basis that an elastic piece 10 was provided on one of the maintaining sections 3*a*. However the invention is not limited in this respect and elastic pieces may be provided on both maintaining sections 3*a* and the same effect as described above will be obtained.

Figure 21:
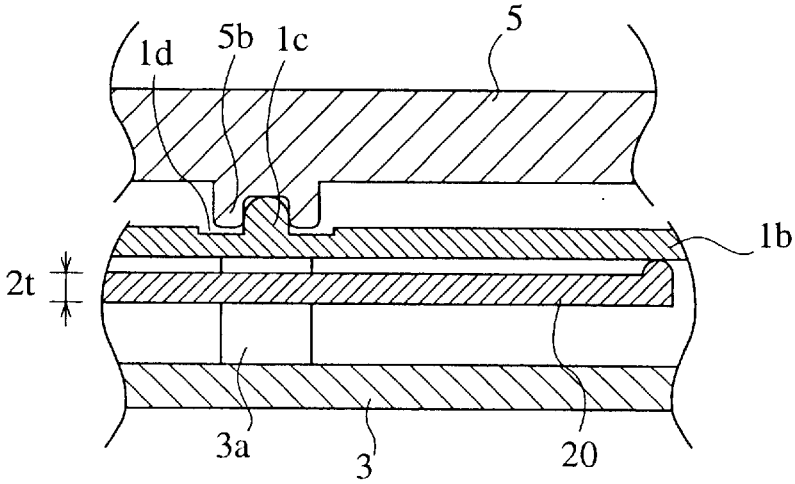
FIG. 21 is a cross sectional view of an application of an elastic piece with a modified thickness.
Figure 22:
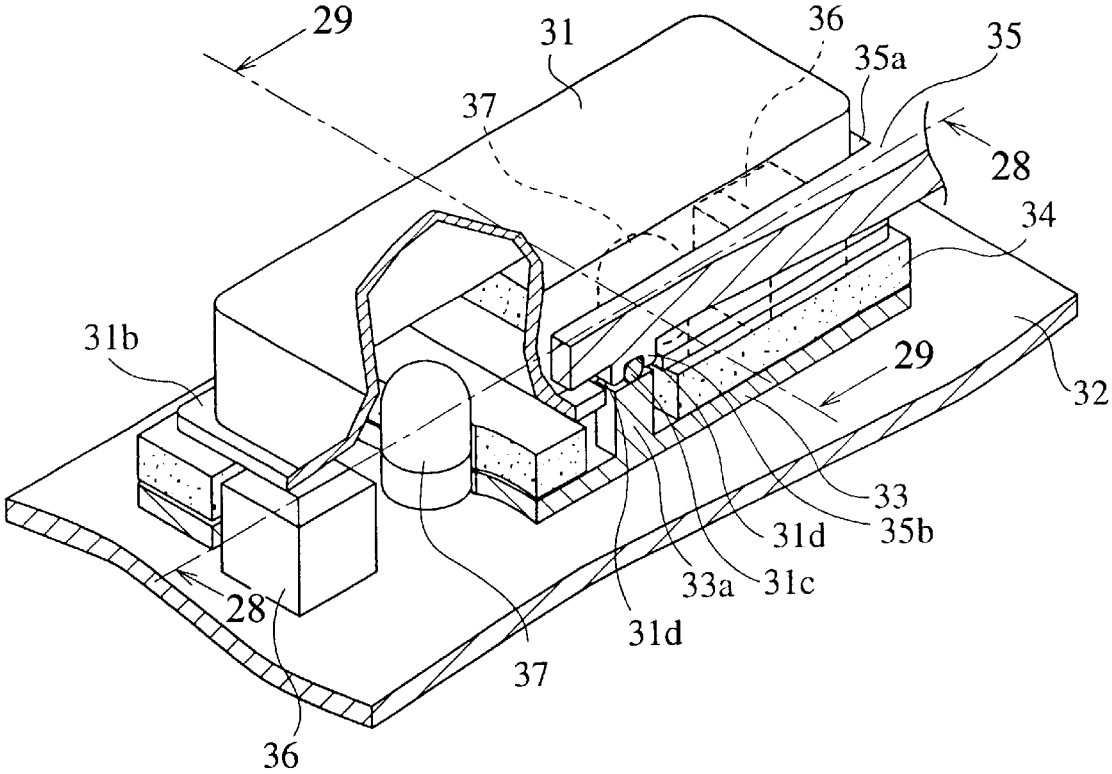
FIG.22 PRIOR ART
FIG. 22 is a schematic perspective figure of a conventional operation device.
Figure 23:
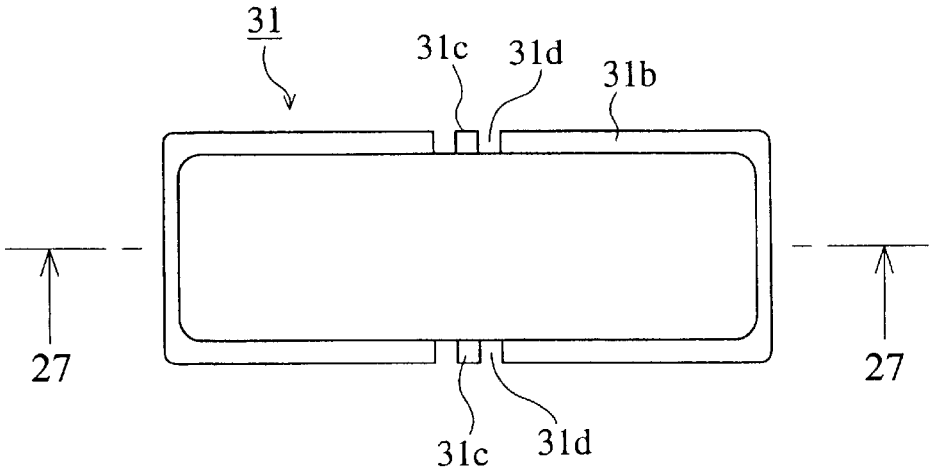
FIG. 23 is a plan view of a button.
Figure 24:
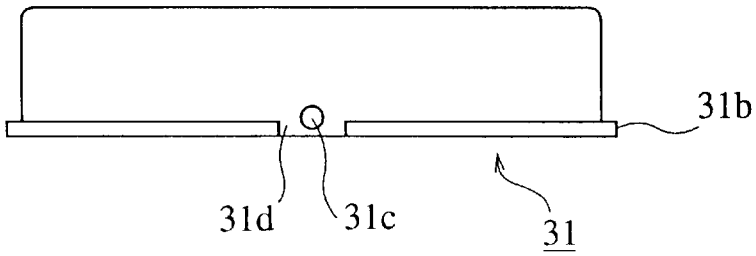
FIG. 24 is a lateral view of a button.
Figure 25:
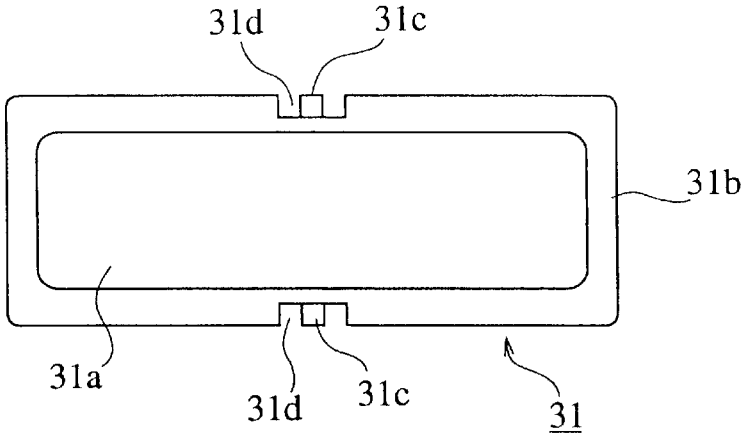
FIG. 25 is a rear view of a button.
Figure 26:
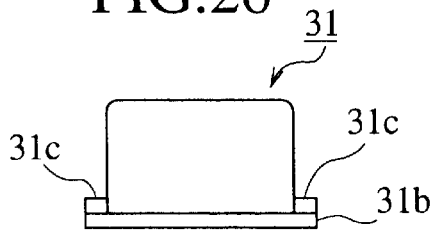
FIG. 26 is a lateral view of a button.
Figure 27:
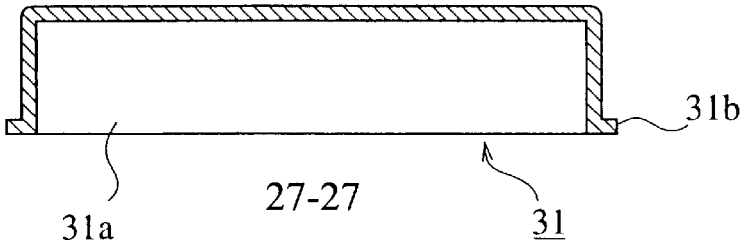
FIG. 27 is a cross sectional view along the line 27—27 of FIG. 23.
Figure 28:
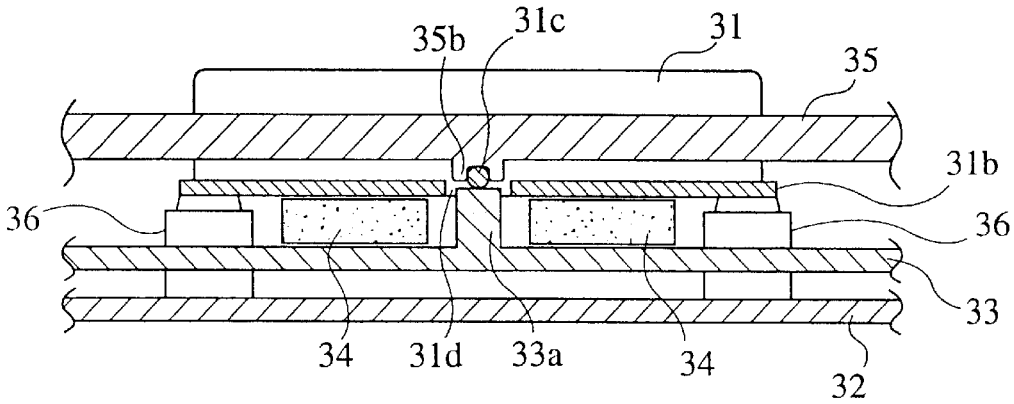
FIG. 28 is a cross sectional view along the line 28—28 of FIG. 22.
Figure 29:
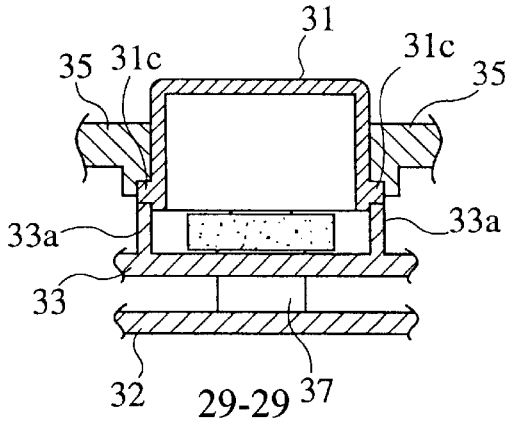
FIG. 29 is a cross sectional view along the line 29—29 of FIG. 22.
Figure 30:
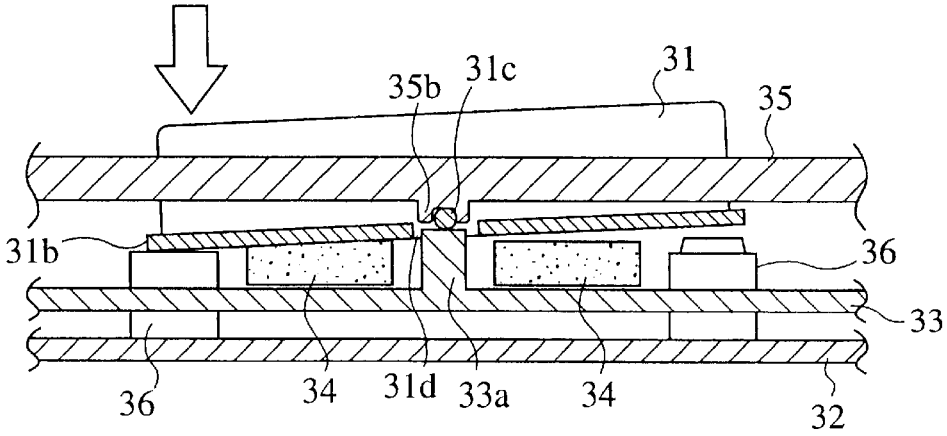
FIG. 30 is a cross section of the operation state of a button.
Figure 31:
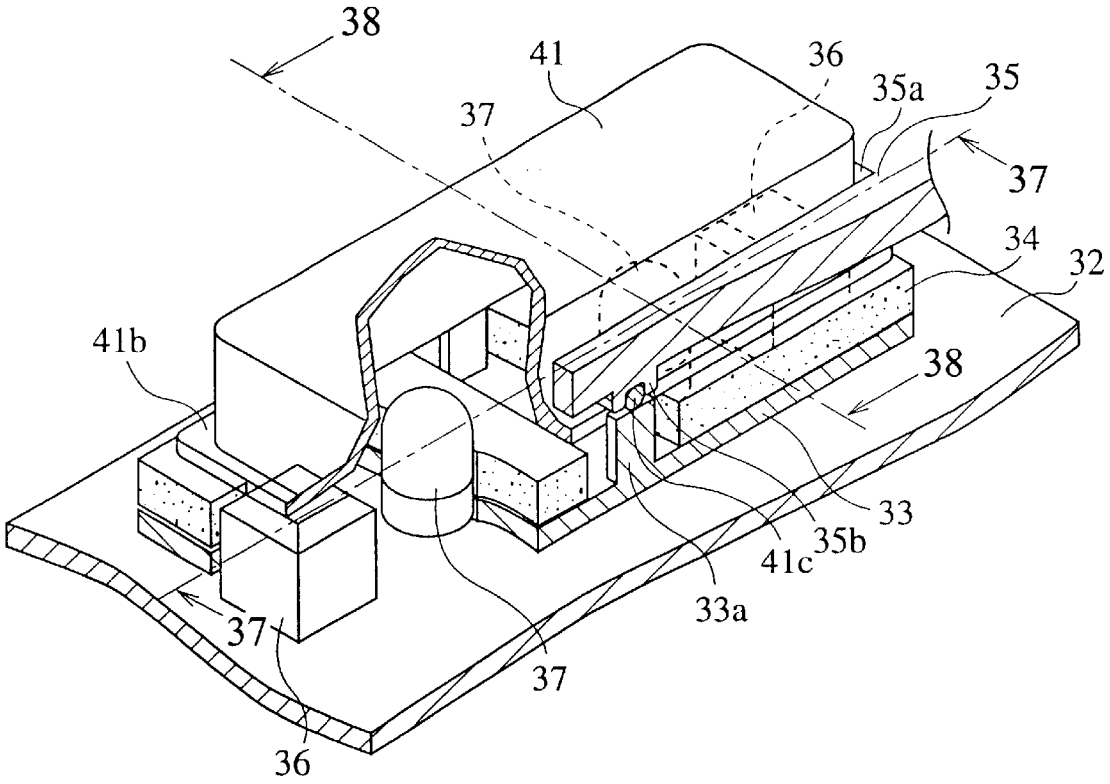
FIG. 31 is a schematic perspective figure of another example of a conventional operation device.
Figure 32:
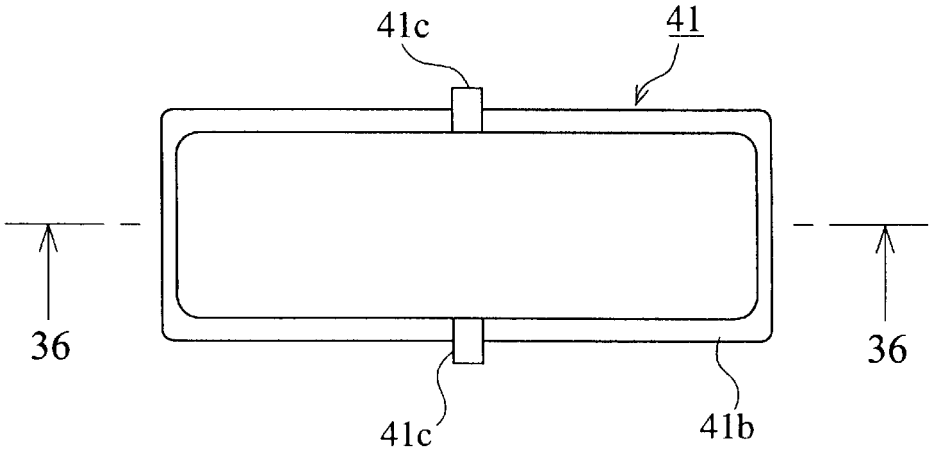
FIG. 32 is a plan view of a button.
Figure 33:
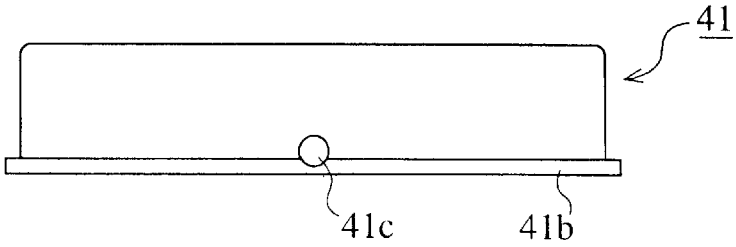
FIG. 33 is a lateral view of a button.
Figure 34:
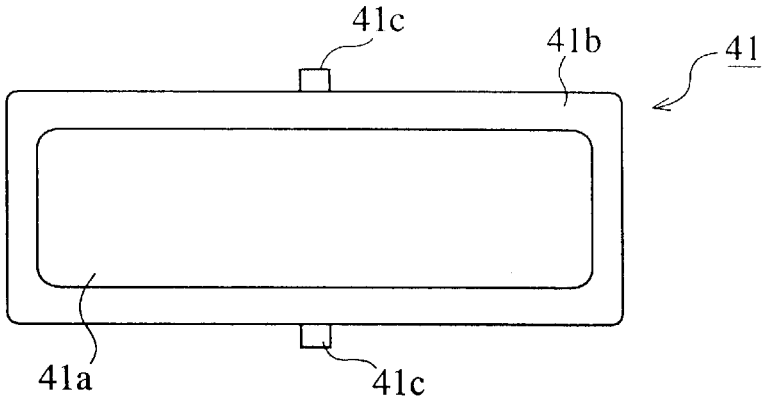
FIG. 34 is a rear view of a button.
Figure 35:
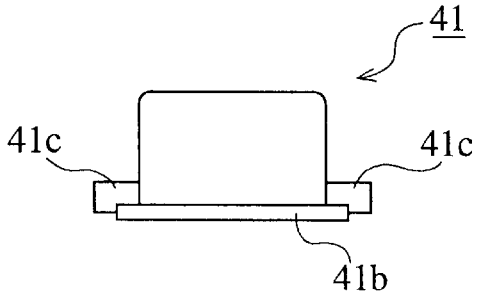
FIG. 35 is a lateral view of a button.
Figure 36:
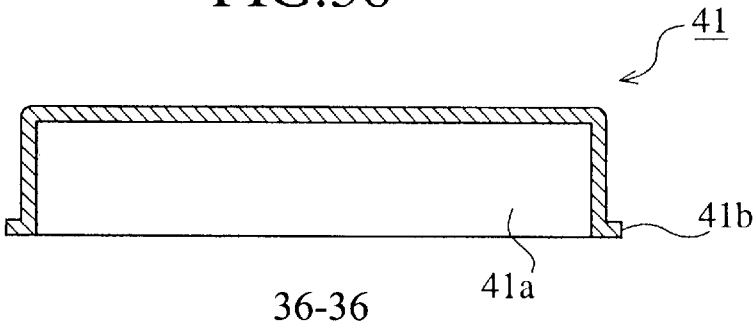
FIG. 36 is a cross sectional view along the line 36—36 of FIG. 32.
Figure 37:
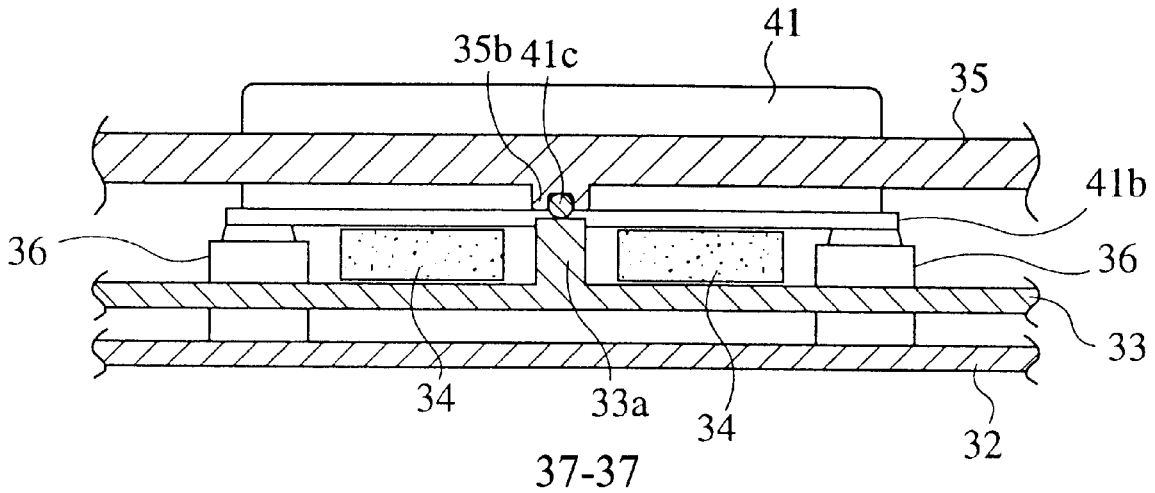
FIG. 37 is a cross sectional view along the line 37—37 of FIG. 31.
Figure 38:
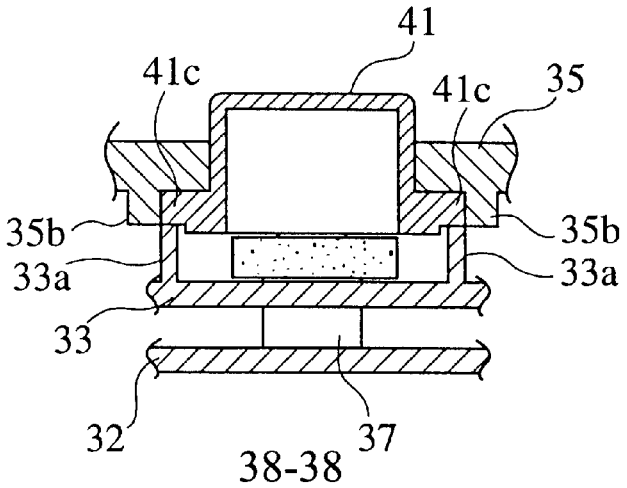
FIG. 38 is a cross sectional view along the line 38—38 of FIG. 31.

Furthermore as shown by FIG. 21, it is possible to freely change the operation of the button 1 by changing the elastic force through the use of an elastic piece 20 of a different thickness (for example two times the thickness of the elastic piece 10 in the figure). FIG. 21 is a cross sectional view showing an example of the invention as adapted to an elastic piece of modified width.

Furthermore the present invention was explained with a lamp 7 provided on the printed wiring board 2 and a flange 1*b* provided on the button 1. However the invention is not limited in this respect and such components need not be provided when the device will not be used in darkness.

INDUSTRIAL APPLICABILITY

As shown above, an operation device according to the present invention is adapted to a car audio or the like which requires reduction in light escaping when the button is illuminated, reductions in the size of the button and smoothness of see-saw operations.

What is claimed is:

1. An operation device comprising:

a mounting board provided with at least a switching element, a front plate, a button depression member arranged between the mounting board and the front plate, a button maintained in a reciprocating position with respect to the front plate by the button depressing member and by the front plate, the button pressuring the switching element, and a button return member returning the button when a pressure has been released, to a pre-operational position, wherein the operation device further comprises;

an outer support section projecting towards an outer face of the button and providing an activation support point when the button reciprocates, an inner support section projecting towards an inner face of the button and providing an activation support point when the button reciprocates, a first maintaining section for the outer support section, provided on the front plate and for maintaining the outer support section in free rotation, and a second maintaining section for the inner support section, provided on the button depression member and for maintaining the inner support section in free rotation.

2. The operation device according to claim 1, wherein the button return member includes a cushion member which is mounted on a button depression member.

3. The operation device according to claim 1, wherein the button return member is integrated with the second maintaining section of the button depression member.

4. The operation device according to claim 1, wherein an illumination element is provided on the mounting board illuminating the button from the rear and a flange is provided continuously on the peripheral edge of an aperture of the button.

5. An operation device comprising:

a mounting board provided with at least one switching element and at least one illuminating element;

a front plate;

a button formed approximately in a box shape having at least four walls defining an aperture, the aperture having a flange formed continuously on at least the outer periphery thereof, the flange arranged between the mounting board and front plate, the flange for engaging the at least one switching element;

an outer support section projecting from a central portion of an outer face of at least two walls of the at least four walls of the button and integrated with the flange, the outer support section providing a first activation support point when the button reciprocates;

an inner support section projecting from the central portion of an inner face of the at least two walls and providing a second activation support point when the button reciprocates;

a first maintaining section provided on the front plate and engaging the outer support section in a first direction, the first maintaining section for maintaining the outer support section in free rotation;

a second maintaining section provided on a button depression member and engaging the inner support section in a second direction opposite the first direction, the button depression member located between the flange and the mounting board, the second maintaining section for maintaining the inner support section in free rotation; and a button return member returning the button when a pressure has been released, to a pre-operational position;

wherein the button is maintained in a reciprocating position with respect to the front plate in that the inner and outer support sections are engaged in cantilevered relation by the button depressing member and by the front plate.

6. An operation device comprising:

a mounting board provided with at least one switching element;

a front plate;

a button formed approximately in a box shape having at least four walls defining an aperture, the aperture having a flange formed continuously on the outer periphery thereof, the flange arranged between the mounting board and front plate, the flange for engaging the at least one switching element;

an outer support section projecting from a central portion of an outer face of at least two walls of the at least four walls of the button and integrated with the flange, the outer support section providing a first activation support point when the button reciprocates;

an inner support section projecting from the central portion of an inner face of the at least two walls and providing a second activation support point when the button reciprocates;

a first maintaining section provided on the front plate and engaging the outer support section in a first direction, the first maintaining section for maintaining the outer support section in free rotation;

a second maintaining section provided on a button depression member and engaging the inner support section in a second direction opposite the first direction, the button depression member located between the flange and the mounting board, the second maintaining section for maintaining the inner support section in free rotation; and a button return member returning the button when a pressure has been released, to a pre-operational position;

wherein the button is maintained in a reciprocating position with respect to the front plate in that the inner and outer support sections are engaged in cantilevered relation by the button depressing member and by the front plate.

* * * * *